US006583537B1

(12) United States Patent
Honda et al.

(10) Patent No.: US 6,583,537 B1
(45) Date of Patent: Jun. 24, 2003

(54) SPARK PLUG WITH BUILT-IN RESISTOR

(75) Inventors: Toshitaka Honda, Aichi (JP); Yutaka Tanaka, Kasugai (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 369 days.

(21) Appl. No.: 09/237,895

(22) Filed: Jan. 27, 1999

(30) Foreign Application Priority Data

Jan. 28, 1998 (JP) ..... 10-032034

(51) Int. Cl.[7] ..... H01T 13/20
(52) U.S. Cl. ..... 313/136; 313/135; 313/141
(58) Field of Search ..... 313/118, 141, 313/142, 136

(56) References Cited

U.S. PATENT DOCUMENTS 3,567,658 A * 3/1971 Webb et al. ..... 252/506
3,903,453 A * 9/1975 Nishio ..... 313/118
4,795,944 A * 1/1989 Stimson ..... 313/136
5,304,894 A 4/1994 Stimson ..... 315/58

FOREIGN PATENT DOCUMENTS

JP 55-30274 8/1980 ..... H01T/13/02
JP 9-50878 2/1997 ..... H01T/13/02

OTHER PUBLICATIONS

Translation of Japanese patent application No. 55–30274 by Nishio, Aug. 1975.*

Translation of Japanese patent No. 09–050878 by Aoki, et al., Feb. 1997.*

* cited by examiner

*Primary Examiner*—Michael H. Day
(74) *Attorney, Agent, or Firm*—Morgan, Lewis & Bockius LLP

(57) ABSTRACT

Disclosed is a spark plug 100 with a built-in resistor comprises an insulator 2 having an axially extending passing-through-hole 6, a terminal metal fitting 13 fixed within the passing-through-hole 6 at an end thereof, a center electrode 3 fixed within the same passing-through-hole at the other end thereof and a resistor 15 provided between the terminal metal fitting 13 and the center electrode 3 within the passing-through-hole 6. A surface layer region including the surface of the center electrode 3 which is exposed to the resistor 15 is a metallic layer 30 formed of a metal based on at least one of Zn, Sn, Pb, Rh, Pd, Pt, Cu, Au, Sb and Ag or a Ni alloy containing at least one of B and P, so that the center electrode 3 is provided in direct contact with the resistor 15 on the surface of the metallic layer 30.

26 Claims, 8 Drawing Sheets

3
6b
2
20
55
6a
6
P
90
72
71

SPARK PLUG WITH BUILT-IN RESISTOR

FIELD OF THE INVENTION

The present invention relates to a spark plug for use on internal combustion engines, more particularly to one having a built-in resistor for preventing the occurrence of electrical noise.

BACKGROUND OF THE INVENTION

A conventional spark plug with a built-in resistor that is of the type contemplated by the invention comprises an insulator having an axially extending passing-through-hole, a terminal metal fitting inserted into the passing-through-hole from one end and fixed therein, a center electrode inserted into the same passing-through-hole from the other end and fixed therein, and a resistor provided between the terminal metal fitting and the center electrode within the passing-through-hole. The effectiveness of such spark plug in preventing electrical noise will generally improve as the length of the resistor increases.

With the conventional spark plug having a built-in resistor, it has been essential that a sealing layer of electro-conductive glass be interposed between the resistor and each of the terminal metal fitting and the center electrode in order to insure that the respective elements have positive electrical joint. As a result, the length of the resistor inevitably decreases by an amount that corresponds to the required thickness of the conductive glass seal layers provided in the space where the terminal metal fitting faces the center electrode. Hence, given a limited space where the terminal metal fitting faces the center electrode, it has been impossible to increase the length of the resistor sufficiently to realize a marked improvement in the prevention of electrical noise.

SUMMARY OF THE INVENTION

An object, therefore, of the present invention is to provide a spark plug with a built-in resistor in an insulator that allows for an increase in the length of the resistor even if the outer dimensions of the insulator are limited and which thereby assures more effective prevention of electrical noise.

DETAILED DESCRIPTION OF THE INVENTION

Figure 1:
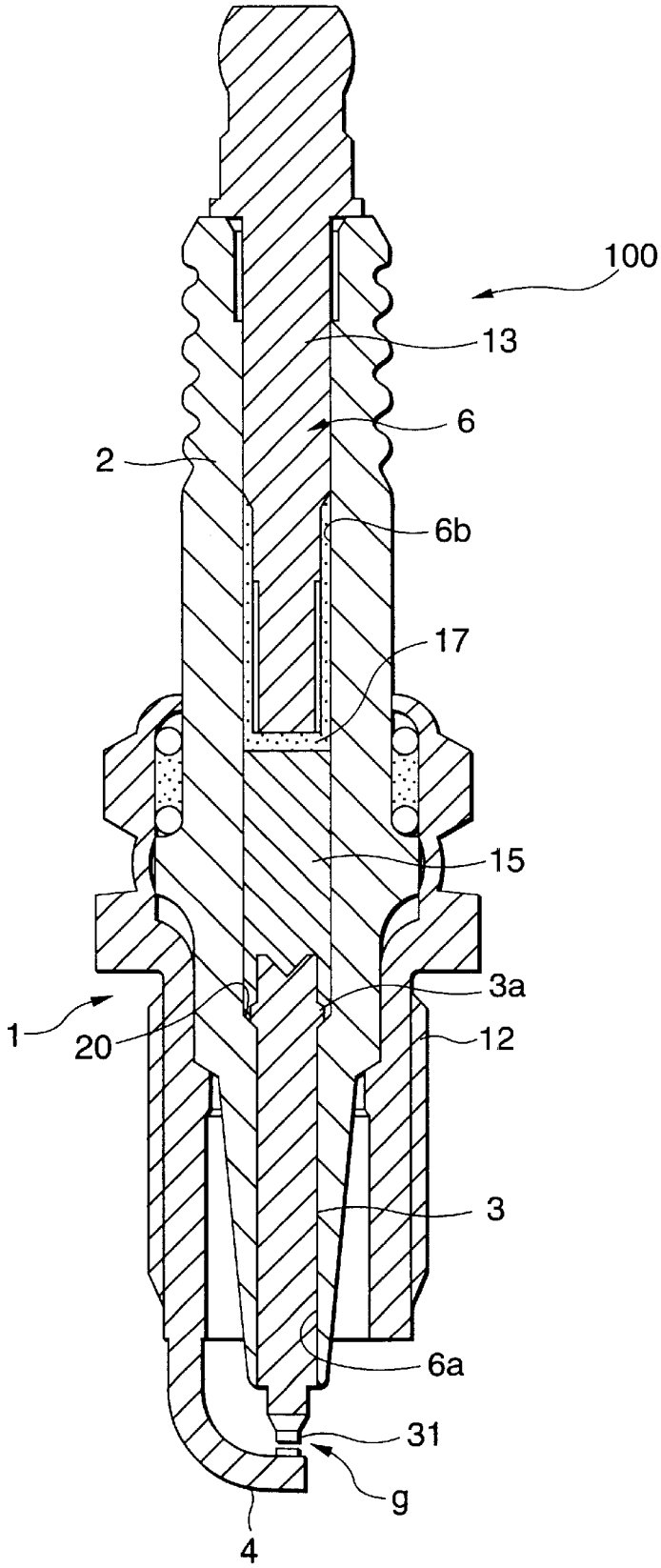
FIG. 1 is a front sectional view of an example of the spark plug of the invention.

The spark plug with a built-in resistor (which is hereinafter referred to simply as a "spark plug") as recited in a first aspect of the present invention is characterized by comprising an insulator having an axially extending passing-through-hole, a terminal metal fitting fixed within the passing-through-hole at an end thereof, a center electrode fixed within the same passing-through-hole at the other end thereof and a resistor provided between the terminal metal fitting and the center electrode within said passing-through-hole, said resistor being formed of a resistor composition which is a mixture of a glass material portion and an electrically conductive material portion, at least one of the terminal metal fitting and the center electrode being such that a surface layer region including the surface exposed to the resistor is a metallic layer formed of a metal based on at least one of Zn, Sn, Pb, Rh, Pd, Pt, Cu, Au, Sb and Ag or a Ni alloy containing at least one of B and P, so that the terminal metal fitting and/or the center electrode is provided in direct contact with the resistor on the surface of said metallic layer.

In the specification, elements are in most cases designated by their symbols.

In the spark plug having the construction set forth in the first aspect of the present invention, a metallic layer of the material defined above is formed on the surface of the terminal metal fitting and/or the center electrode (which are hereinafter sometimes collectively referred to as the "center electrode related metal composing portion"), so that a direct and satisfactory electrical joint can be formed between the resistor which is a mixture of the glass material portion with the electrically conductive material portion and said center electrode related metal composing portion and this contributes to insure a practically satisfactorily value for the life characteristic of the spark plug under load. As a result, the conductive glass seal layer that has been interposed between the terminal metal fitting and/or the center electrode and the resistor in spark plugs of the prior art construction can be eliminated and the length of the resistor can accordingly be increased to realize a spark plug capable of effective prevention of electrical noise.

The spark plug construction set forth in the first aspect of the present invention has not an electrically conductive glass seal layer and yet a satisfactory electrical joint can be formed between the center electrode related metal composing portion and the resistor. Two principal reasons for this effect may be as follows: first, the metallic layer formed of the material defined above helps improve the wettability of the center electrode related metal composing portion with the glass material portion of the resistor composition; secondly, the metallic nature of the layer formed on the mating surface provides ease in securing an electrical continuity between the conductive material portion of the resistor composition and the center electrode related metal composing portion.

The metallic layer described above can be formed by electrolytic plating or a chemical plating method such as electroless plating. The metallic layer may also be formed by a vapor-phase film forming technique such as vacuum evaporation, ion plating or sputtering.

The thickness of the metallic layer may preferably be at least 0.1 m (a second aspect of the present invention), more preferably 1 to 20 $\mu$m. The upper limit of the thickness of the metallic layer is preferably 100 $\mu$m. If its thickness is less than 0.1 $\mu$m, no satisfactory electrical joint is formed between the glass material portion of the resistor composition and its electrically conductive material portion and the electrical resistance of the spark plug will increase to such a value that its life characteristic under load may occasionally be impaired. The thickness of the metallic layer is more desirably at least 1 $\mu$m.

The spark plug as recited in a third aspect of the present invention is characterized by comprising an insulator having an axially extending passing-through-hole, a terminal metal fitting fixed within the passing-through-hole at an end thereof, a center electrode fixed within the same passing-through-hole at the other end thereof and a resistor provided between the terminal metal fitting and the center electrode within said passing-through-hole, said resistor being formed of a resistor composition which is a mixture of a glass material portion and an electrically conductive material portion, at least one of the terminal metal fitting and the center electrode being such that a surface layer region including the surface exposed to the resistor is an electrically conductive or semiconductive oxide layer having a thickness of at least 0.1 $\mu$m, so that the terminal metal fitting and/or the center electrode is provided in direct contact with the resistor on the surface of said oxide layer.

The oxide layer defined above is formed on the surface of the terminal metal fitting and/or the center electrode, so that a direct and satisfactory electrical joint can be formed between the resistor which is a mixture of the glass material portion with the electrically conductive material portion and said terminal metal fitting or center electrode and this contributes to insure a practically satisfactory value for the life characteristic of the spark plug under load. As a result, the conductive glass seal layer that has been interposed between the center electrode related metal composing portion and the resistor in spark plugs of the prior art construction can be eliminated and the length of the resistor can accordingly be increased to realize a spark plug capable of effective prevention of electrical noise.

The spark plug construction set forth in the third aspect of the present invention has not an electrically conductive glass seal layer and yet a satisfactory electrical joint can be formed between the center electrode related metal composing portion and the resistor. Two principal reasons for this effect maybe as follows; fist, the oxide layer defined above helps improve the wettability of the center electrode related metal composing portion with the glass material portion of the resistor composition; secondly, the conductive or semiconductive nature of the oxide layer formed on the mating surface provides ease in securing an electrical continuity between the conductive material portion of the resistor composition and the center electrode related metal composing portion.

If the thickness of the oxide layer is less than 0.1 $\mu$m, no satisfactory electrical joint is formed between the glass material portion of the resistor composition and its electrically conductive material portion and the electrical resistance of the spark plug will increase to such a value that its life characteristic under load may occasionally be impaired. The thickness of the oxide layer is more desirably at least 1 $\mu$m.

The oxide layer may be a Ni-based oxide layer. The term "Ni-based oxide" used herein refers to oxides of which a major elemental metal component is Ni and which are exemplified by those containing NiO as a main component. Since NiO is semiconductive, the oxide layer containing it as a major component also has a relatively high conductivity; in addition, it has good wettability with the glass component of the resistor composition. Therefore, a NiO-based oxide layer is suitable for use in the present invention.

The center electrode and/or the terminal metal fitting (collectively referred to as the "center electrode related metal composing portion") may be formed of Ni or a Ni alloy (selected from various Ni-based heat-resistant alloys such as Inconel). If a metallic layer of the above-defined material is to be formed, the center electrode related metal composing portion formed of Ni or a Ni alloy has satisfactory adhesion to the metallic layer and, hence, is suitable for use in the invention. If a Ni-based oxide layer is to be formed, the center electrode related metal composing portion formed of Ni or a Ni alloy has the advantage that the intended Ni-base oxide layer can be easily formed by oxidizing the surface layer portion of said center electrode related metal composing portion by a suitable method. Exemplary methods of forming the Ni-base oxide layer by this approach include the following; holding the center electrode related metal composing portion at a high temperature (e.g. 700° C. or more) in an oxygen-containing atmosphere (e.g. atmospheric air) so that the surface of the center electrode related metal composing portion on which an oxide layer is to be formed is thermally oxidized; contacting a surface of the center electrode related metal composing portion with steam at a high temperature (e.g. 700° C. or more); and oxidation. Another method that can be adopted is contacting a surface of the center electrode related metal composing portion with various oxidizing agents. Exemplary oxidizing agents that can be used in this method include halogen gases such as chlorine and bromine or liquids having such halogen gases dissolved therein; acids such as nitric acid, hydrochloric acid and chlorine-containing oxoacids (e.g. chloric acid and perchloric acid) or aqueous solutions thereof; aqueous solutions of chromic acid or bichromic acid or salts thereof; aqueous solutions of permanganic acid or salts thereof; and hydrogen peroxide. Two or more of the methods described above of forming the Ni-based oxide layer may be employed in combination.

Aside from the above-mentioned Ni-base oxide layer, the oxide layer to be used in the present invention can be formed not only by the above-described oxidation treatments but also by vapor-phase film forming techniques such as RF sputtering, reactive sputtering and CVD, as well as sol-gel methods in which hydrous oxide sols are prepared as by hydrolysis of metal alkoxides, then coated, dried and subsequently heated to produce oxide films. By these methods, various kinds of electrically conductive or semiconductive oxide layers can be formed as exemplified by layers of indium oxide ($In_2O_3$), tin oxide ($SnO_2$), chromium oxide ($Cr_2O_3$ or $CrO_2$), vanadium oxide ($V_2O_3$ or $VO_2$) and titanium oxide ($TiO_2$).

The spark plug as recited in a fourth aspect of the present invention is characterized by comprising an insulator having an axially extending passing-through-hole, a terminal metal fitting fixed within the passing-through-hole at an end thereof, a center electrode fixed within the same passing-through-hole at the other end thereof and a resistor provided between the terminal metal fitting and the center electrode within said passing-through-hole, said resistor being formed of a resistor composition which is a mixture of a glass material portion and an electrically conductive material portion, both the terminal metal fitting and the center electrode being based on Ni and at least one of said terminal metal fitting and said center electrode being such that a surface layer region including the surface exposed to the resistor is a Ni-based oxide layer having a thickness of at least 0.1 $\mu$m, so that the terminal metal fitting and/or the center electrode is provided in direct contact with the resistor on the surface of said oxide layer.

The thickness of the Ni-based oxide layer is preferably 1 to 20 $\mu$m. The upper limit of the thickness of the Ni-based oxide layer is preferably 100 $\mu$m.

The resistor may be formed of a resistor composition that has a structure comprising a mixture of a glass material portion with an electrically conductive material portion and which also contains one or more auxiliary elemental components selected from among Zn, Sb, Sn, Ag, Ni and Al in a total amount of 0.02 to 2 wt % (a fifth aspect of the present invention). If the resistor which is a mixture of the glass material portion and the electrically conductive material portion further contains a metallic component selected from among the elements mentioned above in amounts within the stated range, the electrical joint between the resistor and the center electrode related metal composing portion can be made more satisfactory, thus achieving a further improvement in the life characteristic of the spark plug under load.

The reason why incorporating the indicated amount of the above-defined auxiliary elemental component in the resistor achieves a further improvement in its electrical joint to the center electrode related metal composing portion may be speculated as follows. To form the resistor, a powder mix containing a glass powder for forming the glass material portion and a conductive material's powder for forming the electrically conductive material portion may be sintered integrally with the center electrode and/or the terminal metal fitting by a suitable method such as hot pressing (e.g. at a temperature of 800 to 1,000° C.) If the conductive material's powder is a metal powder containing one or more of the auxiliary elemental components mentioned above, for example, metals of comparatively low melting point such as Zn, Sb and Sn, these components are melted at least partially during sintering to produce a liquid phase and a new metallic layer based on the liquid phase (which is hereinafter referred to as "a metallic layer on the resistor side") will form between the resistor and the center electrode related composing portion, which would further enhance the electrical continuity between the two members. If the above-mentioned metallic layer is formed on the side closer to the center electrode related metal composing portion (such a metallic layer is hereinafter referred to as "a metallic layer on the metal composing portion side"), an enhanced adhesion of the mating surfaces due to the interposed metallic layer may be another plausible reason. If Ag and Ni which have comparatively high melting points are used as auxiliary elemental components in the electrically conductive material's powder, they may diffuse toward the metal layer on the metal composing portion side or the oxide layer during sintering to eventually enhance the adhesion of the mating surfaces.

If the total content of the above-defined auxiliary elemental components in the resistor is less than 0.02 wt %, their effectiveness in improving the adhesion between the mating surfaces is not significant. If, on the other hand, the total content of the above-defined auxiliary elemental components in the resistor exceeds 2 wt %, its electrical resistivity becomes so low that failure to accomplish the intended prevention of electrical noise will sometimes occur. The total content of the auxiliary elemental components in the resistor is desirably 0.2 to 2 wt %, more desirably 0.2 to 1 wt %.

It is worth mention that if one or more of the above-defined auxiliary elemental components are contained in the resistor, a satisfactory electrical joint may sometimes be created between the resistor and the center electrode related metal composing portion even if the above-described metallic layer on the metal composing portion side or the oxide layer is not deliberately formed on the mating surface of the center electrode related metal composing portion. Take, for example, the case where the resistor contains auxiliary elemental components of comparatively low melting point such as Zn, Sb and Sn; they will melt at least partially during sintering to produce a liquid phase and a kind of brazing effect due to the liquid phase would enhance the adhesion of the joint and, hence, the electrical continuity to the center electrode related metal composing portion. If the resistor contains Ag and Ni as the auxiliary elemental components, they would diffuse toward the mating surface of the center electrode related metal composing portion to eventually enhance the adhesion of the joint.

If the above-mentioned auxiliary elemental components are to be contained in the resistor, their total content is set to lie within the range of 0.02 to 2 wt %, desirably 0.2 to 1 wt %. Particularly significant effects are achieved if Sb, Sn, Ag and Ni are used as the auxiliary elemental components. If Zn is to be used, a significant effect can be achieved by increasing its content up to 0.6 wt % and higher (desirably 0.7 wt % and higher) To achieve first mentioned effect, the spark plug of the present invention may be constructed as recited in a sixth aspect of the present invention and it is characterized by comprising an insulator having an axially extending passing-through-hole, a terminal metal fitting fixed within the passing-through-hole at an end thereof, a center electrode fixed within the same passing-through-hole at the other end thereof and a resistor provided between the terminal metal fitting and the center electrode within said passing-through-hole, said resistor being formed of a resistor composition that has a structure comprising a mixture of a glass material portion with an electrically conductive material portion and being provided in direct contact with either the terminal metal fitting or the center electrode or both, and the resistor composition containing one or more auxiliary elemental components selected from among Sb, Sn, Ag and Ni in a total amount of 0.02 to 2 wt %.

To achieve the second mentioned effect, the spark plug of the invention may be constructed as recited in a seventh aspect of the present invention and it is characterized by comprising an insulator having an axially extending passing-through-hole, a terminal metal fitting fixed within the passing-through-hole at an end thereof, a center electrode fixed within the same passing-through-hole at the other end thereof and a resistor provided between the terminal metal fitting and the center electrode within said passing-through-hole, said resistor being formed of a resistor composition that has a structure comprising a mixture of a glass material portion with an electrically conductive material portion and being provided in direct contact with either the terminal metal fitting or the center electrode or both, and the resistor composition containing 0.6 to 2 wt % of Zn as an auxiliary elemental component.

If the above-mentioned auxiliary elemental components are to be contained in the resistor, at least part of them is desirably contained in the form of a metallic phase for the purpose of improving the electrical joint between the resistor and the center electrode related metal composing portion (an eighth aspect of the present invention). Whether or not the auxiliary elemental components are contained in the form of a metallic phase can be checked by any known analytical methods such as X-ray diffraction, X-ray photoelectron spectroscopy (XPS) and electron spectroscopy for chemical analysis (ESCA).

If Ni is to be contained as an auxiliary elemental component, it can be incorporated as a powder of a Ni-based brazing material that is based on Ni and which additionally contains one or more of Cr, B, Si, C, Fe and P (a ninth aspect of the present invention) If the above-defined metallic phase is to be formed in the resulting resistor, it is Ni-base phase that is based on Ni and which additionally contains one or more of Cr, B, Si, C, Fe and P. The Ni-based brazing material having this compositional feature has a lower melting point than elemental Ni and by selecting a material having a solidus temperature near the temperature at which the resistor composition is sintered (e.g. at a temperature of 800 to 1,000° C.), an even better electrical joint can be provided between the resistor and the center electrode related metal composing portion.

An example of the Ni-based brazing material that can be used is one that is based on Ni and which contains at least one of 5 to 21 wt % Cr, 2.5 to 4 wt % B, 3 to 11 wt % Si, not more than 0.15 wt % of C, 1 to 5 wt % Fe and 9 to 13 wt % P.

If desired, an electrically conductive glass seal layer may be interposed between the terminal metal fitting and the resistor. In this case, the center electrode is provided in direct contact with the resistor (a tenth aspect of the present invention). The terminal metal fitting in a spark plug with a built-in resistor is connected to a high-pressure supply portion during service and, hence, is prone to receive a tensile force or the like in the axial direction; under the circumstances, it is often advantageous to insure a greater mechanical strength of joint between the terminal metal fitting and the resistor by inserting an electrically conductive glass seal layer.

As already mentioned, the construction of the conventional spark plug with a built-in resistor is such that an electrically conductive glass seal layer is formed on both sides of the resistor in the axial direction. Hence, considering the distance between the opposed ends of the terminal metal fitting and the center electrode which is written as LS and the length of the resistor which is written as LR (both LS and LR being taken in the direction in which the terminal metal fitting is opposed to the center electrode), the ratio of LR to LS cannot be made larger than about 0.7 in the conventional spark plug. However, this value can be increased to more than 0.7 by adopting the structural features defined in the preceding paragraphs (an eleventh aspect of the present invention). As a result, the effectiveness of the spark plug with a built-in resistor in preventing electrical noise can be enhanced to a by far higher level than in the prior art. It should be noted that the length of the resistor LR refers to the length of a region in which the passing-through-hole in the insulator is filled with the resistor composition throughout its cross section taken perpendicular to the axis (which length is hereinafter referred to as the "seal length").

If the threaded portion formed on the body metal of the spark plug for assisting in its mounting on an engine has an outside diameter of 8 to 18 mm or if a cross section of the resistor taken perpendicular to the axis has a diameter of 3.0 to 4.7 mm, the length of the resistor LR is preferably adjusted to lie within the range of 5 to 20 mm. If LR is less than 5 mm, an excessive voltage will be exerted on a unit length of the resistor when a high voltage is applied to the spark plug for producing a spark discharge and this may shorten the life of the resistor. On the other hand, if the passing-through-hole in the insulator is filled with a feed powder which is hot pressed in the axial direction to make the resistor, LR in excess of 20 mm will unduly increase the friction between the feed powder and the inner surfaces of the passing-through-hole and no adequate pressure will be effectively applied to the powder packing during hot pressing. As a result, the resistor produced tends to have an insufficient density and the life characteristic of the spark plug under load will sometimes deteriorate. More desirably, LR is adjusted to lie within the range of 5 to 15 mm.

We now describe desired embodiments of the present invention with respect to the resistor composition that forms the resistor. The resistor composition can be prepared as one comprising 3 to 20 wt % of glass particles less than 150 μm in size (which are hereinafter referred to as "fine-particulate glass"), 60 to 90 wt % of glass particles in a size range of 150 to 800 μm (which are hereinafter referred to as "coarse-particulate glass") —these two classes of glass particles comprise the aforementioned glass material portion—, 2 to 32 wt % of non-glass ceramic particles, 0.05 to 2 wt % of a metallic phase containing one or more of the aforementioned auxiliary elemental components, and 0.5 to 5.0 wt % of a nonmetallic, electrically conductive material.

Figure 2:
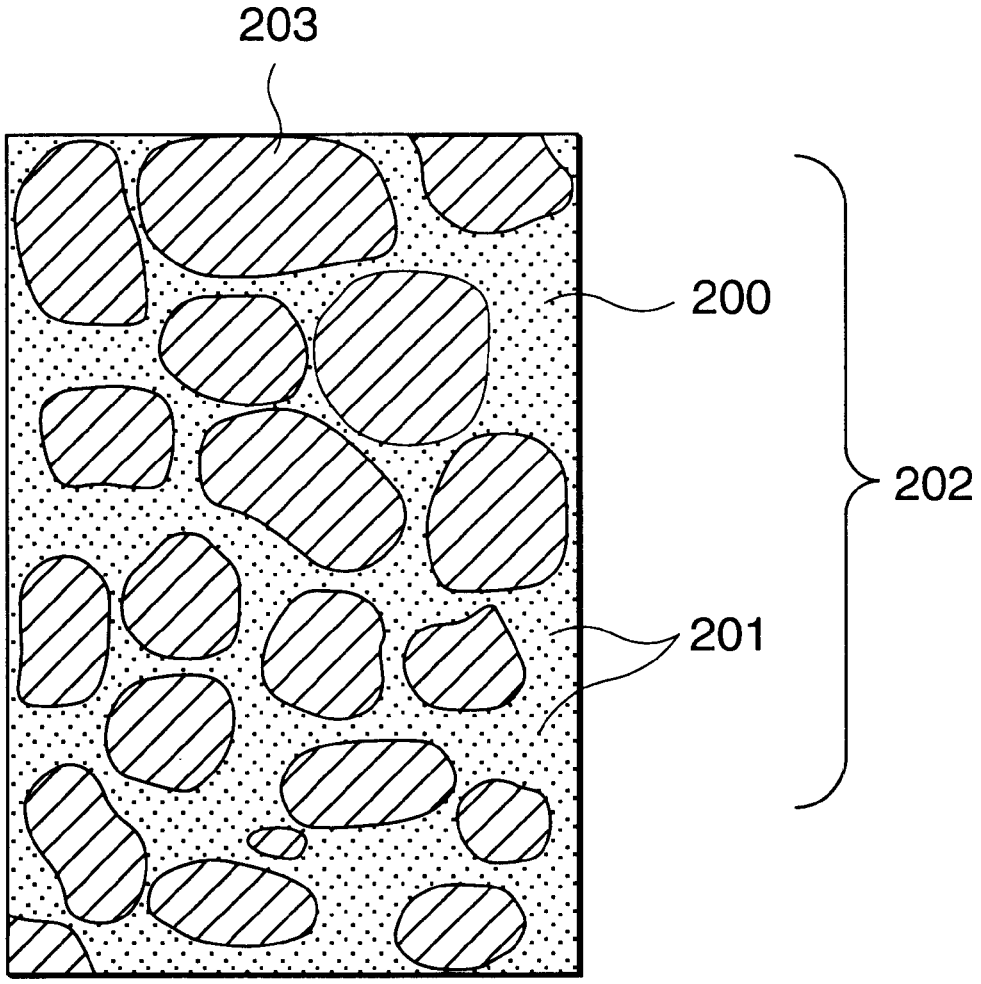
FIG. 2 shows diagrammatically the microstructure of the resistor in the spark plug of FIG. 1.

FIG. 2 shows schematically the microstructure of the above-described resistor composition. Briefly, at least part of the fine-particulate glass is melted and then solidifies to form a bound glass phase 200, in which the particles of the metallic phase and those of the nonmetallic, electrically conductive material (the two classes of particles are hereinafter collectively referred to as a "powder of conductive material 201") are dispersed to form a conductor path forming portion 202. The conductor path forming portion will form a so-called "block structure" that surrounds block glass particles 203 derived from the coarse-particulate glass. In this case, at least part of the bound glass phase forms a continuous portion that extends from an end of the resistor on the terminal metal fitting side to the other end on the center electrode side and this continuous portion in turn forms conductor paths in the resistor on account of the electrical contact between adjacent particles in the powder of conductive material. The continuous portion, namely, the conductor paths are caused to get around the block particles at every site in the resistor and their effective length is sufficiently increased to accomplish satisfactory prevention of electrical noise.

The function of the fine-particulate glass is such that at least part of it is melted during sintering as by hot pressing so as to fill the gaps formed between adjacent particles of the coarse-particulate glass powder. If the particle size of the fine-particulate glass is 150 μm or more, only insufficient melting will occur and voids are prone to form in the conductor paths, which may potentially deteriorate the life characteristic of the spark plug under load. Desirably, the particle size of the fine-particulate glass powder is set to 100 μm and less. On the other hand, if the particle size of the coarse-particulate glass is less than 150 μm, the particles are prone to soften or melt during hot pressing and the above-described block structure is impaired and there can be accomplished no satisfactory prevention of electrical noise. If the particle size of the coarse-particulate glass exceeds 800 μm, voids are prone to remain between glass particles, which may potentially deteriorate the life characteristic of the spark plug under load.

If the weight of the fine-particulate glass is less than 3 wt % or the weight of the coarse-particulate glass exceeds 90 wt %, the glass will hardly melt during hot pressing and so many voids will form between glass particles that the life characteristic of the spark plug under load will deteriorate. On the other hand, if the weight of the fine-particulate glass exceeds 20 wt % or the weight of the coarse-particulate glass is less than 60 wt %, the proportion of the block particles in the resistor composition will decrease and the formation of the block structure is insufficient to accomplish satisfactory prevention of electrical noise. Desirably, the weight of the fine-particulate glass is set to lie within the range of 3 to 12 wt % whereas the weight of the coarse-particulate glass is set to lie within the range of 70 to 85 wt %.

The non-glass ceramic particles may be composed as ones that are based on at least one member selected from among $TiO_2$, $ZrO_2$, $ZrSiO_4$, $Al_2O_3$, MgO, Al-Mg spinel, mullite and so forth. If the content of the non-glass ceramic particles is outside the range of 2 to 32 wt %, the life characteristic of the spark plug under load may potentially deteriorate. Desirably, the content of the non-glass ceramic particles is adjusted to lie within the range of 3 to 20 wt %.

If the content of the metallic phase or the nonmetallic conductive material is higher than the respective upper limit of the stated range, there may be an occasional failure to achieve the intended prevention of electrical noise. If the content of the metallic phase or the nonmetallic conductive material is smaller than the lower limit of the stated range, the life characteristic of the spark plug under load may potentially deteriorate. The content of the metallic phase is desirably adjusted to lie within the range of 0.2 to 2 wt %, more desirably within the range of 0.2 to 1 wt %. The content of the non-metallic conductive material is desirably adjusted to lie within the range of 0.5 to 3.0 wt %.

The nonmetallic conductive material may be composed as one that is based on at least one member selected from among amorphous carbon, graphite, SiC, TiC, WC and ZrC. In this case, the content of carbon in the resistor composition is preferably adjusted to lie within the range of 0.5 to 5.0 wt %. If the carbon content is less than 0.5 wt %, the life characteristic of the spark plug under load may potentially deteriorate. If the carbon content exceeds 5.0 wt %, there may be an occasional failure to achieve the intended prevention of electrical noise. More desirably, the carbon content is adjusted to lie within the range of 0.5 to 3.0 wt %. It should be noted that the nonmetallic conductive material may occasionally contain a carbon content derived from the organic binders used in powder molding.

The glass particles that can be used in the invention are those which specifically contain at least one glass powder selected from among $B_2O_3$—$SiO_2$, $_{BaO—B2}O_3$, $SiO_2$—$B_2O_3$—CaO—BaO and $SiO_2$—ZnO—$B_2O_3$ based glass powders. If a glass powder having a softening point of no more than 800° C. is used, the fluidity of the molten glass is so much enhanced that the bound glass phase will sufficiently fill the gaps between block particles that there is only a small chance of the formation of gaps and other defects. As a result, the life characteristic of the spark plug under load is improved. The term "softening point of glass" as used herein shall mean the temperature at which the viscosity coefficient of the glass becomes $4.5\times10^7$ poises. If the softening point of the glass is less than 300° C., the heat resistance of the resistor is impaired; hence, it is desirable to use a glass having a softening point of 300 to 800° C., more desirably 600 to 800° C. If necessary, the coarse-particulate glass (or block glass particles) and the fine-particulate glass (or bound glass phase) may be composed of different glass materials.

The glass particles to be used in the invention are desirably made of such materials that the softening point of the fine-particulate glass is not different from the softening point of the coarse-particulate glass by more than 100° C. In a mathematical expression, it is desired that $|TF-TC|\leqq100°$ C., where TF represents the softening point of the fine-particulate glass and TC the softening point of the coarse-particulate glass. In this case, TF may be greater or smaller than TC. The technical rationale for $|TF-TC|\leqq100°$ C. is as follows. Even if the fine-particulate glass has the same viscosity coefficient as the coarse-particulate glass, the former by nature is more prone to deform than the latter during hot pressing. If TF>TC on the condition that $|TF-TC|\leqq100°$ C., the fine-particulate glass, even if it has a slightly higher softening point than the coarse-particulate glass, will sufficiently deform under the pressure applied during hot pressing that it will fill the gaps between particles of the coarse-particulate glass, thereby ensuring that the life characteristic of the spark plug under load is maintained at a satisfactory level. However, if $|TF-TC|>100°$ C., the fine-particulate glass will deform only insufficiently and gaps will form between particles of the coarse-particulate glass, which may potentially lead to deterioration in the life characteristic of the spark plug under load. If TF<TC, the fine-particulate glass becomes more prone to deform and there is a smaller chance for the formation of gaps and other defects; however, if $|TF-TC|>100°$ C., the viscosity coefficient of the glass is unduly low and voids are prone to occur in the conductor path forming portion on account of foaming of the fine-particulate glass, potentially leading to deterioration of the life characteristic of the spark plug under load. Therefore, $|TF-TC|$ is desirably 100° C. or less, more desirably 50° C. or less.

Several embodiments of the present invention will now be described with reference to the accompanying drawings.

FIG. 1 shows a spark plug with a built-in resistor according to an embodiment of the invention. The spark plug generally indicated by 100 comprises basically a tubular body metal 1, an insulator 2 fitted into the body metal 1 with its upper half projecting out, a center electrode 3 placed within the insulator 2 with the firing tip 31 projecting out, and a ground electrode 4 connected at one end to the body metal 1 and provided to face a lateral side of the firing tip 31 (of the center electrode 3). The tip of the ground electrode 4 is bent in such a way that its surface is substantially parallel to the lateral side of the firing tip 31, whereby a spark gap g is formed between the tip surface of the ground electrode 4 and the outer surface of the firing tip. The basal end of the ground electrode 4 is welded or otherwise secured to the body metal 1 to form a unitary assembly. The body metal 1 is typically formed of carbon steel and, as shown in FIG. 1, its portion closer to the firing tip 31 has a threaded portion 12 formed on the periphery to assist in mounting of the spark plug on an engine. The threaded portion typically has an outside diameter of 8 to 18 mm, specifically 18 mm, 14 mm, 12 mm or 10 mm.

The insulator 2 has a passing-through-hole 6 formed in an axial direction and a terminal metal fitting 13 is inserted into the passing-through-hole 6 from one end and fixed whereas the center electrode 3 is inserted form the other end and fixed. A resistor 15 is provided between the terminal metal fitting 13 and the center electrode 3 within the passing-through-hole 6. The center electrode 3 and the terminal metal fitting 13 are both made of a Ni alloy such as Inconel (trade mark). The insulator 2 is made of a sintered ceramic material such as alumina.

The passing-through-hole 6 in the insulator 2 consists of a generally cylindrical first portion 6*a* through which the center electrode 3 is to be inserted and a generally cylindrical second portion 6*b* that is formed backward (upward in FIG. 1) of and in a larger diameter than the first portion 6*a*. The terminal metal fitting 13 and the resistor 15 are received in the second portion 6*b* whereas the center electrode 3 is inserted in the first portion 6*a*. A rib 3*a* is formed like a flange at the rear end of the center electrode 3 such that it projects outwards from the periphery to assist in fixing the center electrode. For receiving the rib 3*a* on the center electrode 3, a tapered or round surface 20 is formed in the area of transition from the first portion 6*a* of the passing-through-hole 6 to the second portion 6*b*.

Figure 3:
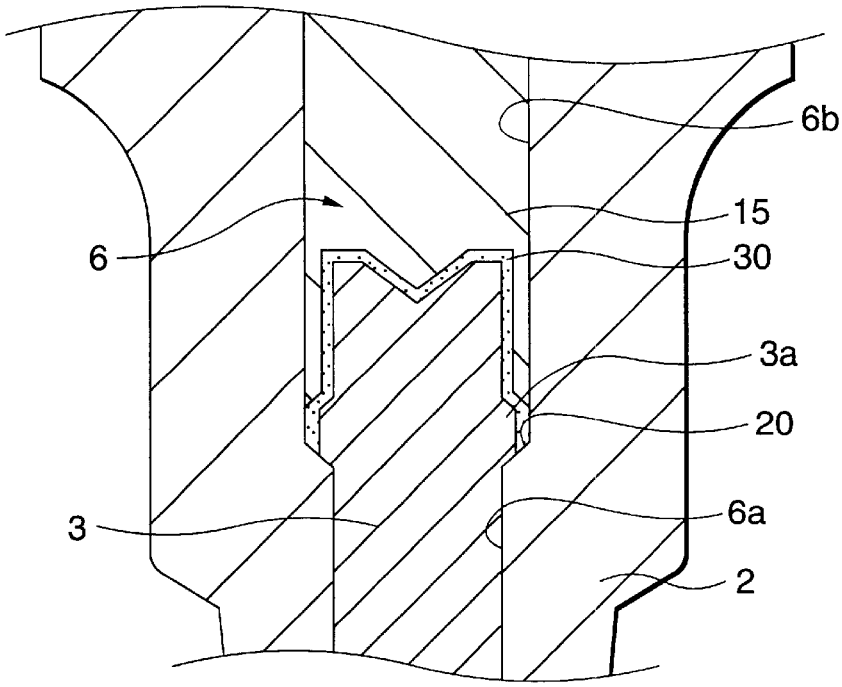
FIG. 3 is a front sectional view showing the essential part of FIG. 1.
Figure 4:
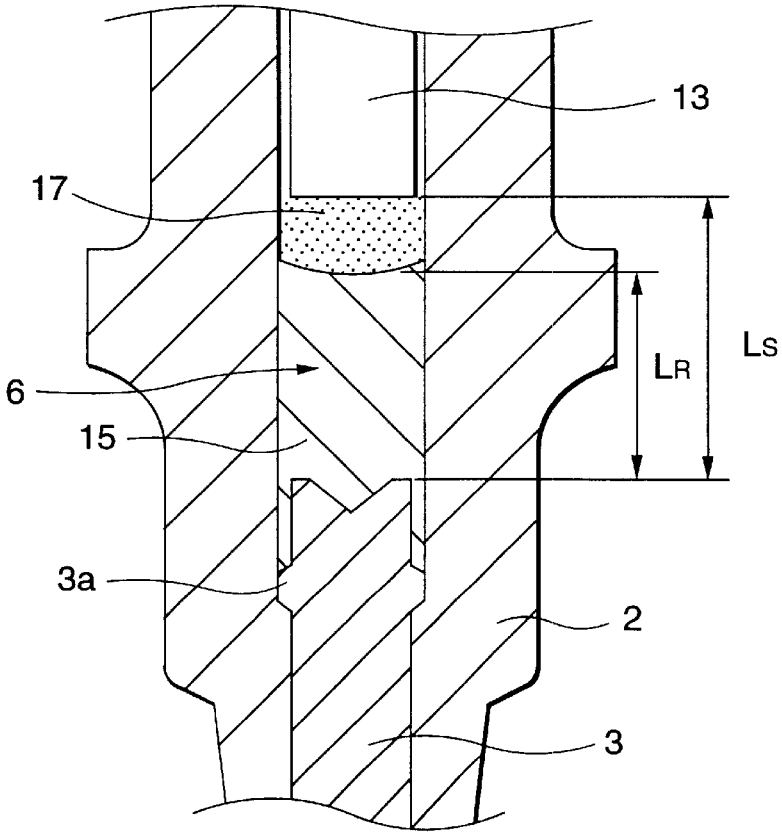
FIG. 4 is a sectional view showing the seal length of the resistor.

As also shown in FIG. 1, the resistor 15 is electrically joined to the terminal metal fitting 13 via an electrically conductive glass seal layer 17. On the other hand, as shown in FIG. 3, the surface layer region of the center electrode 3 including the surface of the rib 3*a* is formed as a metallic layer 30 so that the center electrode 3 makes direct contact with the resistor 15 on the surface of the metallic layer 30. The metallic layer 30 may be formed by electrolytic plating or a chemical plating method such as electroless plating and has a thickness of at least 0.1 μm, desirably at least 1 μm. Further, considering the distance between the opposed ends of the terminal metal fitting 13 and the center electrode 3 which is written as LS and the distance of the resistor 15 which is written as LR (both LS ad LR being taken in the direction in which the terminal metal fitting 13 is opposed to the center electrode 3, namely, taken along the longitudinal central axis of the insulator 2), the ratio of LR/LS is adjusted to be at least 0.7. It should be noted that the length LR of the resistor 15 refers to the length of a region in which the passing-through-hole 6 in the insulator 2 is filled with a resistor composition throughout its cross section taken perpendicular to the axis (which length is hereinafter referred to as the "seal length"). The diameter of a cross section of the resistor 15 taken perpendicular to the axis is selected from the range of 3.0 to 4.7 mm depending upon the inside diameter of the passing-through-hole 6 in the insulator 2.

The resistor 15 is produced from a mix of specified amounts of a glass power, a ceramic powder, a metal powder (based on at least one of Zn, Sb, Sn, Ag and Ni), a nonmetallic conductive material's powder (e.g., amorphous carbon or graphite), an organic binder and so forth, the mix being subsequently sintered by a known technique such as hot pressing. The resistor 15 is prepared form a resistor composition having the following recipe: 3 to 20 wt % of glass particles less than 150 μm in size (which particles are hereinafter referred to as "fine-particulate glass"), 60 to 90 wt % of glass particles with a size range of 150 to 800 μm (which particles are hereinafter referred to as "coarse-particulate glass"), 2 to 32 wt % of non-glass particulate ceramics (e.g. those which are based on at least one of $TiO_2$, $ZrO_2$, $ZrSiO_4$, $Al_2O_3$, MgO, Al—Mg spinel and mullite), 0.05 to 2 wt % of a metallic phase based on at least one of Al, Mg, Ti, Zr and Zn, and 0.5 to 5.0 wt % of a nonmetallic conductive material. The microstructure of the resistor 15 has already been described with reference to FIG. 2. The conductive glass seal layer 17 is made of glass mixed with a metal powder based on at least one metal component such as Cu, Sn or Fe. If necessary, a powder of a semiconductive inorganic compound such as $TiO_2$ may be incorporated in a suitable amount in the conductive glass seal layer 17.

Figures 5A, 5B, 5C, 5D:
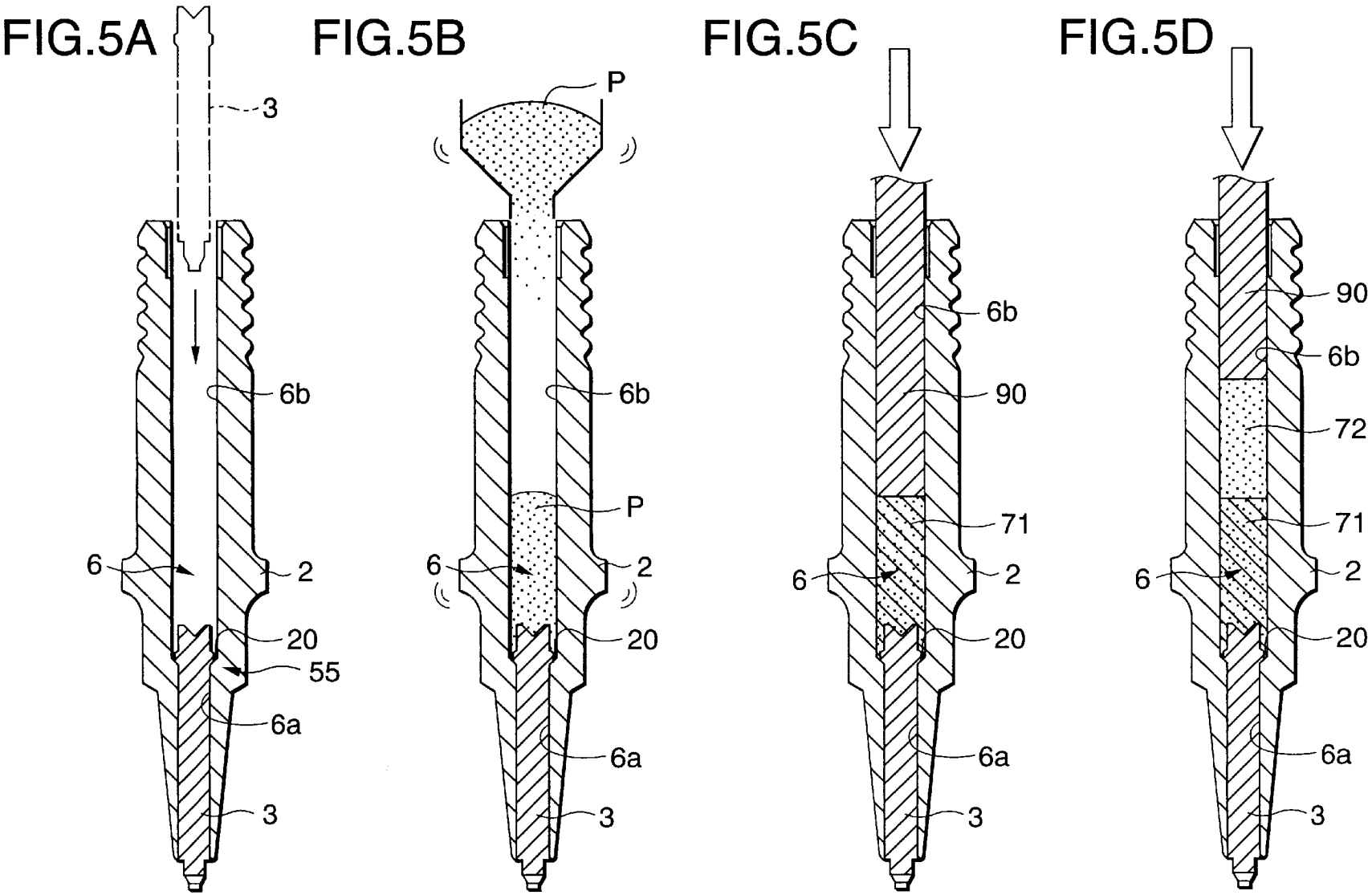
FIGS. 5A to 5D illustrate the sequence of steps in the manufacture of the spark plug of FIG. 1.

To fabricate the spark plug 100 with a built-in resistor, the center electrode 3 and the terminal metal fitting 13 can be mounted in the insulator 2 and each of the resistor 15 and the conductive glass seal layer 17 formed by the following methods. First, as shown in FIG. 5A, the center electrode 3 (which has the metallic layer 30 preliminarily formed on the surface of the electrode fixing rib 3*a*) is inserted into the first portion 6*a* of the passing-through-hole 6 in the insulator; thereafter, as shown in FIG. 5B, a feed powder P for the resistor composition is packed into the second portion 6*b* of the passing-through-hole 6. Then, as shown in FIG. 5C, a plunger 90 is inserted into the second portion 6*b* and the packed powder P is partially compressed to form a layer of the resistor composition's powder 71. Subsequently, a conductive glass powder is packed in the second portion 6*b* and partially compressed, whereupon the second portion 6*b* of the passing-through-hole 6 is filled with the layer of the resistor composition's powder 71 and a layer of the conductive glass powder 72 that are superposed in the order written, with the layer 71 positioned the closer to the center electrode 3 (in the lower part of FIG. 5D).

Figure 6A:
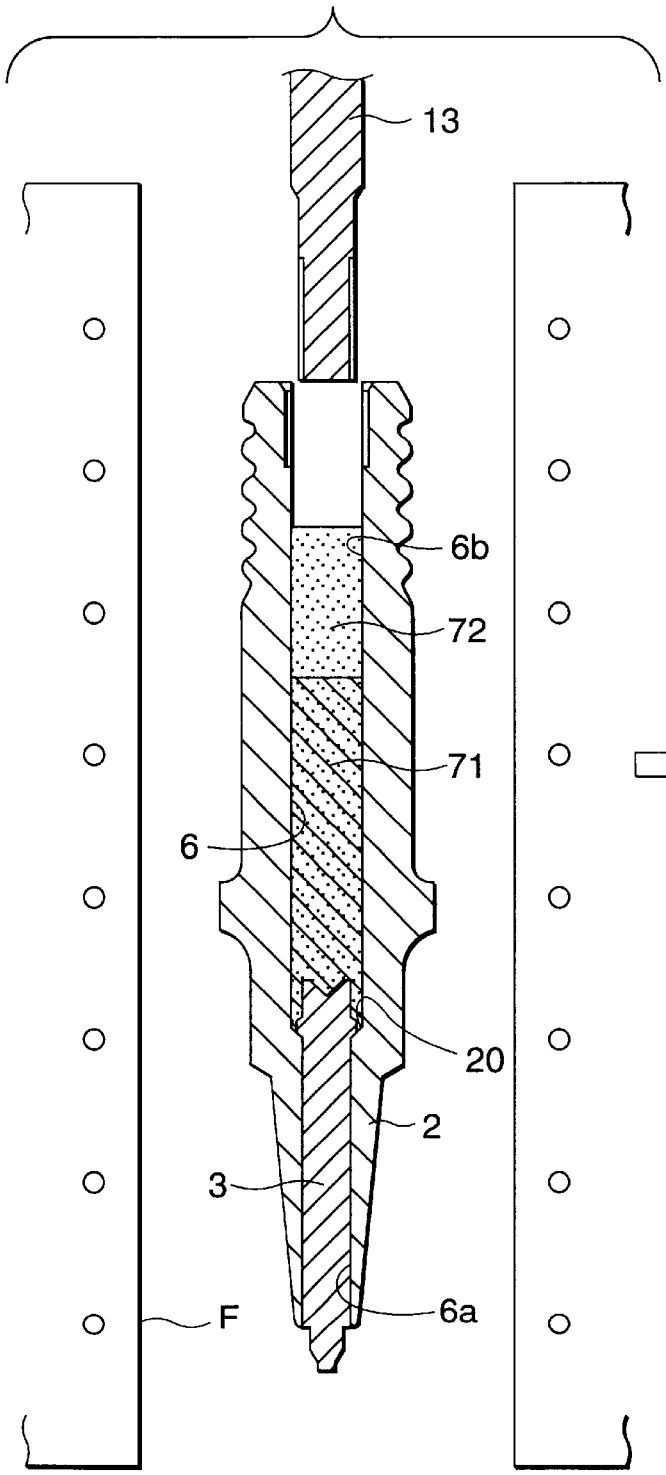
FIGS. 6A to 6B illustrate the steps subsequent to those shown in FIGS. 5A–5D.
Figure 6B:
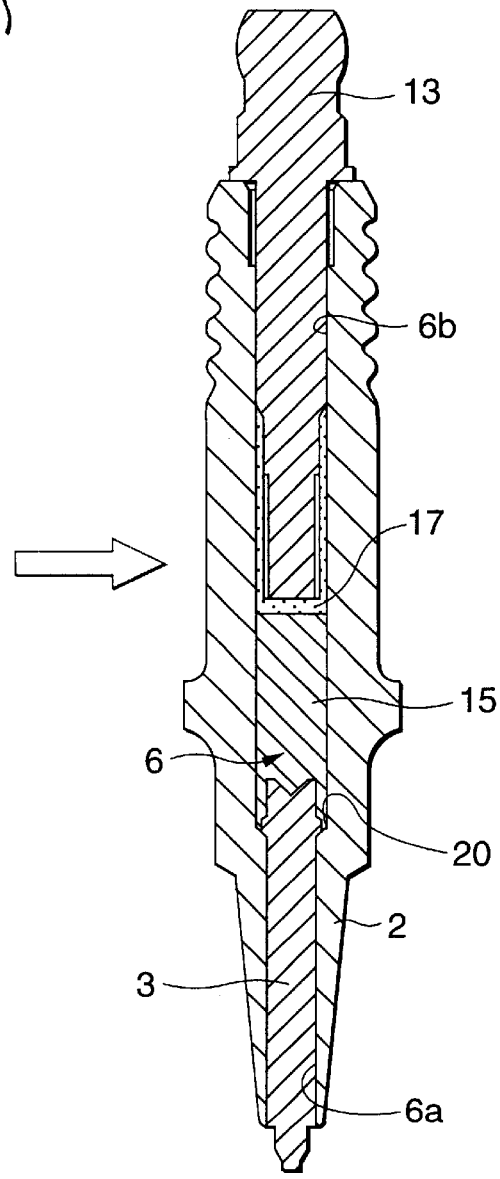

Then, as shown in FIG. 6A, the entire assembly is inserted into a furnace F and heated to 800 to 1,000° C. which is higher than the softening point of the glass. Thereafter, the terminal metal fitting 13 is pressed into the second portion 6*b* of the passing-through-hole 6 from the side opposite to the center electrode 3 and the superposed layers 71 and 72 are hot pressed with the pressure applied in the axial direction, whereupon the individual layers 71 and 72 are compressed fully and sintered to produce the resistor 15 and the conductive glass seal layer 17 (see FIG. 6B).

The metallic layer 30 formed on the surface where the electrode fixing rib 3*a* (on the center electrode 3) contacts the resistor 15 as shown in FIG. 3 creates a direct and satisfactory electrical joint between the center electrode 3 and the resistor 15 and this ensures a satisfactory value for the life characteristic of the spark plug 100 under load. The structural design shown in FIG. 3 also contributes to eliminate the conductive glass seal layer conventionally interposed between the center electrode 3 and the resistor 15 and the length of the resistor 15 is accordingly increased to realize more effective prevention of electrical noise.

Figure 7:
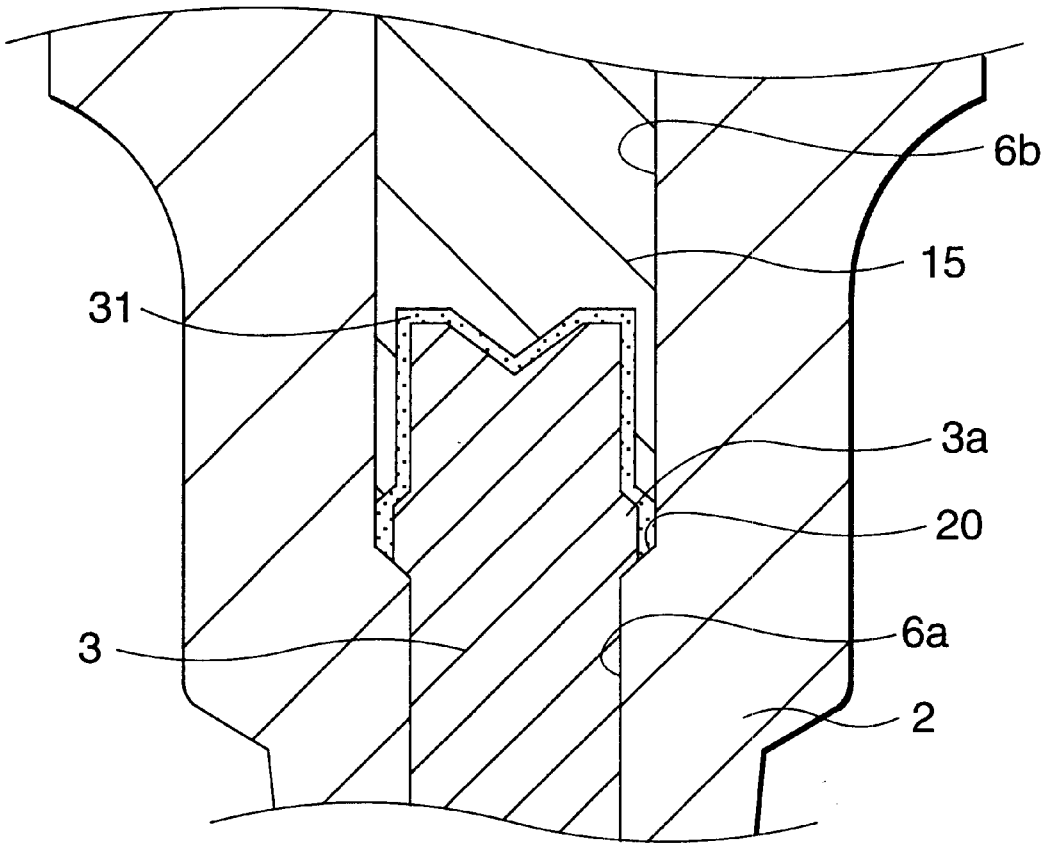
FIG. 7 is a front sectional view showing the essential part of another example of the spark plug of the invention.

It should be noted that the spark plug 100 shown in FIG. 1 may have the metallic layer 30 (FIG. 3) replaced by a Ni-based oxide layer which is indicated by 31 in FIG. 7. The Ni-based oxide layer 31 may be formed in a thickness of at least 0.1 μm, desirably at least 1 μm, by treating the surface of the electrode fixing rib 3*a* on the center electrode 3 in one of the following ways: oxidizing the rib surface at a high temperature of at least 700° C. in an oxygen-containing atmosphere (say, atmospheric air); contacting the rib surface with steam at a temperature of at least 700° C.; contacting the rib surface with one or more of the aforementioned oxidizing agents; and anodizing the rib surface.

Figure 8:
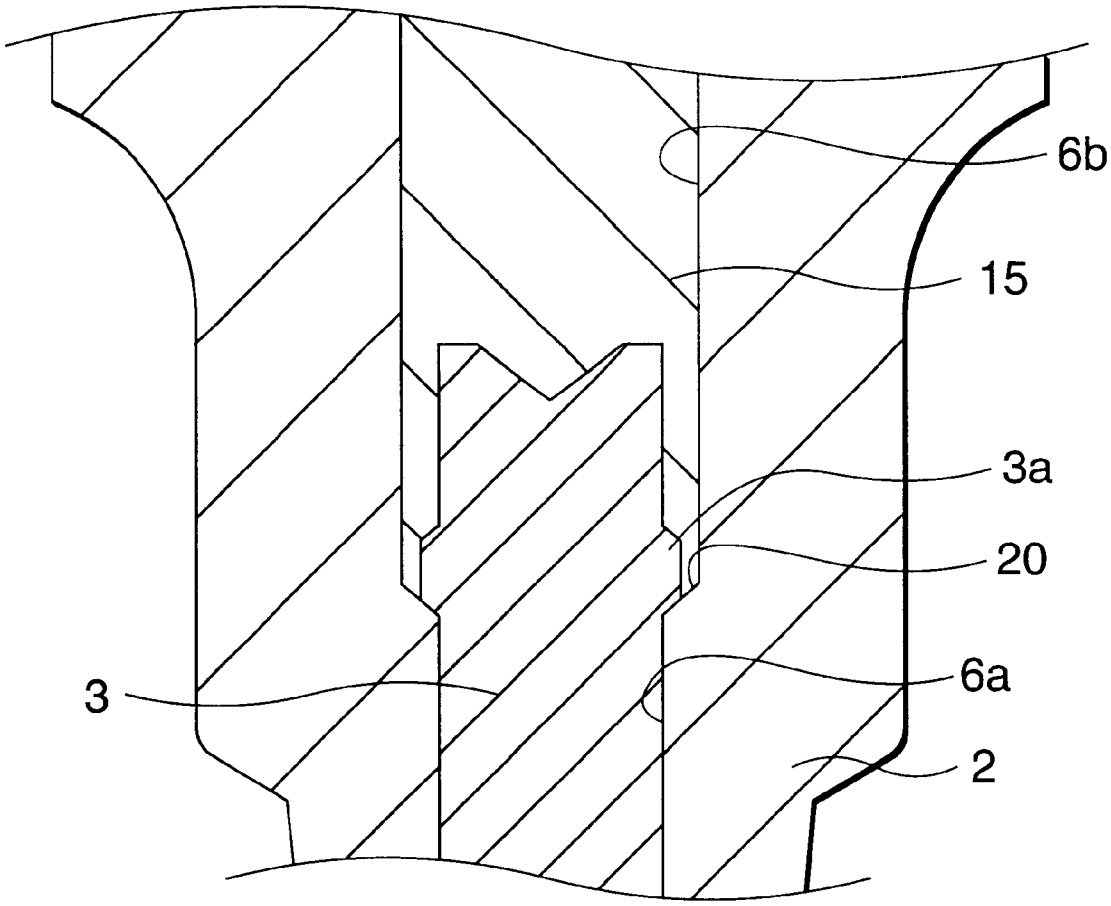
FIG. 8 is a front sectional view showing the essential part of yet another example of the spark plug of the invention.

In the structural designs shown in FIGS. 3 and 7, the resistor 15 may further contain at least one auxiliary elemental component selected from among Zn, Sb, Sn, Ag, Ni and Al in a total amount of 0.02 to 2 wt %, desirably 0.2 to 1 wt %. In this case, the feed powder for the resistor composition P shown in FIGS. 5A–5D will incorporate 0.02 to 2 wt %, desirably 0.2 to 2 wt %, more desirably 0.6 to 2 wt %, most desirably 0.6 to 1 wt %, of a metallic powder based on one or more the auxiliary elemental components mentioned above. This helps provide an even better electrical joint between the electrode fixing rib 3*a* (on the center electrode 3) and the resistor 15, whereby the life characteristic of the spark plug under load is further improved. In the case under consideration, the rib 3*a* may be provided with neither a metallic layer nor an oxide layer as shown in FIG. 8. If this special design is to be adopted, at least one auxiliary elemental component selected from among Sb, Sn, Ag and Ni should be contained in a total amount of 0.02 to 2 wt %, desirably 0.2 to 1 wt %. If Zn is to be contained, it should be added in an amount of 0.6 to 2 wt %, desirably 0.6 to 1 wt %.

Figure 9:
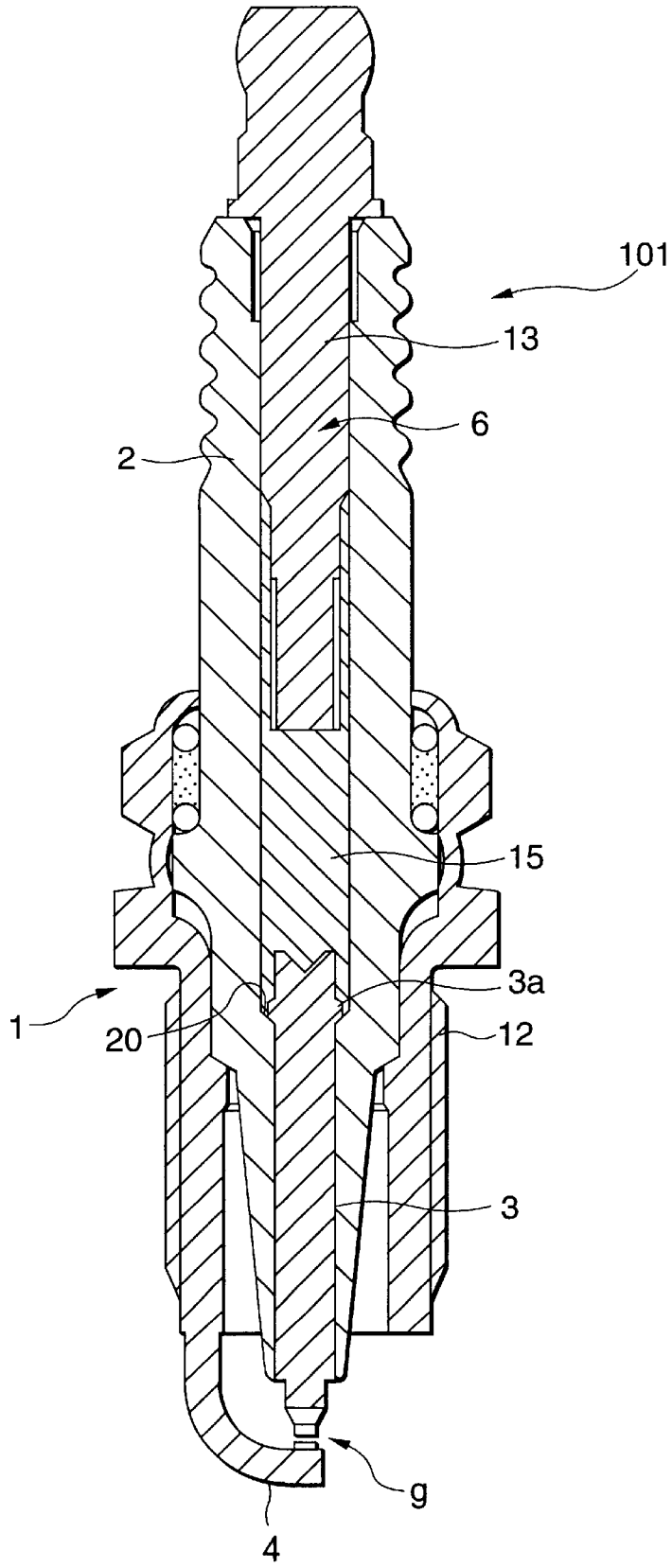
FIG. 9 is a front sectional view showing a further example of the spark plug of the invention.

In the spark plug described above, it is only the center electrode 3 that makes direct contact with the resistor 15. However, this is not the sole case of the invention and the above-defined metallic layer or oxide layer may also be formed on the mating surface of the terminal metal fitting 13 and/or at least one auxiliary elemental component selected from among Zn, Sb, Sn, Ag, Al and Ni may be contained in the resistor 15 in a total amount of 0.02 to 2 wt %. Then, the terminal metal fitting 13 can also have direct contact with the resistor 15 as shown in FIG. 9, from which the conductive glass seal layer 17 appearing in FIG. 1 is omitted.

EXAMPLE 1

Thirty percent by weight of a fine glass powder (average particle size=80 μm), 60 wt % of a ceramic $ZrO_2$ powder (average particle size=3 μm), 1 wt % of a metallic Al powder (average particle size=20 to 50 μm), 6 wt % of a nonmetallic conductive carbon black powder and 3 wt % of dextrin as an organic binder were wet mixed in solvent water by means of a ball mill. The mixture was thereafter dried to prepare a preform. To 100 parts by weight of the preform, 400 parts by weight of a coarse glass powder (average particle size=250 μm) was added to prepare a feed powder for a resistor composition. Each glass powder was a lithium borosilicate glass produced from a melt of a formulation consisting of 50 wt % $SiO_2$, 29 wt % $B_2O_5$, 4 wt % $LiO_2$ and 17 wt % BaO; its softening point was 585° C.

Using the powder of resistor composition, various samples of spark plug 100 with a built-in resistor having the construction shown in FIG. 1 were fabricated by the method shown in FIGS. 5 and 6. The center electrode 3 was made of a Ni alloy (Inconel; approximately consisting of 76 wt % Ni, 15.5 wt % Cr, 8 wt % Fe, 0.5 wt % Mn and 0.2 wt % Si) and it had an outside diameter of 3.5 mm across the electrode fixing rib 3*a* (see FIG. 3) and an axial length of 20 mm; on the mating surface of the center electrode, a Ni-based oxide layer 31 (see FIG. 7), as well as various metallic layers 30 (see FIG. 3) made of Zn, solder (Sn-10 wt % Pb alloy), Rh, Pd, Pt, Cu, Au, Ni-B alloy (with 0.3 to 0.8 wt % B), Ni-P alloy (with 8 wt % P), Sb and Ag were formed in varying thickness (Sample Nos. 1 to 30). The Ni-based oxide layer was formed by contacting the surface of the rib 3*a* with steam at 900° C. for 1 to 2 hours and its thickness was measured by examining its section with a scanning electron microscope (SEM). The formed Ni-based oxide layer was identified by X-ray diffraction as mainly consisting of Ni(II) oxide (NiO). The metallic layers made of Ni-B and Ni-P alloys were formed by electroless plating and the other metallic layers were formed by electrolytic plating. The thicknesses of the metallic layers were measured with an X-ray fluorescence gage meter or a micrometer. The species and thickness of the metallic or oxide film are shown in Table 1 for each sample.

The passing-through-hole 6 in the insulator 2 had an inside diameter of 4.0 mm which was substantially the same as the diameter of a cross section of the resulting resistor 15 that was taken perpendicular to its axis. For the hot pressing, the heating temperature was set at 900° C. and the applied pressure at 100 kg/cm$^2$. The conductive glass powder was a mixture of a conductive powder of Cu, Fe, Sn, $TiO_2$ or the like and a powder of sodium borosilicate glass (the content of the conductive powder being about 50 wt %) The spark plug samples fabricated had LR and LS values of 13.5 mm and 15 mm, respectively, with LR/LS being 0.9; LR was the seal length of the resistor 15 and LS was the distance between the opposed ends of the terminal metal fitting 13 and the center electrode 3. As comparative Example 1, a spark plug was fabricated that had neither metallic nor Ni-based oxide layer formed on the surface of the center electrode 3 (Sample No. 31). As Comparative Example 2, a spark plug was also fabricated that had neither metallic nor Ni-based oxide layer formed on the surface of the center electrode 3 but which had a conductive glass seal layer also formed between the center electrode 3 and the resistor 15 (Sample No. 32). In Comparative Example 2, LR (the seal length of the resistor 15) was 9.75 mm and LS (the distance between the opposed ends of the terminal metal fitting 13 and the center electrode 3) was 15 mm, with LR/LS being 0.65.

The strength of the electric field of the interfering waves from the spark plugs was measured by the method in accordance with the specifications of the CISPR (international Special Committee on Radio Interference) to evaluate their electrical noise performance at two test frequencies, 65 MHz (on the lower side) and 120 MHz (on the higher side). The results of measurement at 65 MHz were rated by the following criteria in terms of the strength of electrical field; excellent (◎) in the range of 24 to 27 dB; good (○) in the range of 27 to 30 dB; (Δ) in the range of 30 to 34 dB; poor (x) in excess of 34 dB. The results of measurement at 120 MHz were rated by the following criteria: excellent (◎) with a field intensity of less than 31 dB; good (○) in the range of 31 to 34 dB; (Δ) in the range of 34 to 37 dB; poor (x) in excess of 37 dB.

The life characteristic of each spark plug under load was measured by the following method: the spark plug was mounted on an auto-motive transistor-based igniter and sparked for 100 hours or 200 hours at a spark discharge voltage of 20 kV with 3,600 spark cycles per minute, followed by the measurement of the resulting change in resistance. The results were rated by the following criteria in terms of the absolute value of the percent change in resistance; good (○) below 20%; fair (Δ) in the range of 20 to 30%; poor (x) in excess of 30%. The overall results are shown in Table 1 below.

TABLE 1

| | Surface forming layer on center electrode | | Electrical noise performance | | Life characteristics | |
|---|---|---|---|---|---|---|
| Sample No. | Kind | Thickness μm | 65 MHz | 120 MHz | under load | Overall rating |
| 1 | Ni-based oxide | 0.05 | Δ | ◎ | ○ | Δ |
| 2 | Ni-based oxide | 0.1 | ○ | ◎ | ○ | ○ |
| 3 | Ni-based oxide | 2 | ○ | ◎ | ○ | ○ |
| 4 | Ni-based oxide | 10 | ○ | ◎ | ○ | ○ |
| 5 | Zn | 0.03 | Δ | ◎ | ○ | Δ |
| 6 | Zn | 0.1 | ○ | ◎ | ○ | ○ |
| 7 | Zn | 1 | ○ | ◎ | ○ | ○ |
| 8 | Zn | 20 | ◎ | ◎ | ○ | ◎ |
| 9 | solder | 0.5 | ○ | ◎ | ○ | ○ |
| 10 | solder | 5 | ○ | ◎ | ○ | ○ |
| 11 | Sn | 0.1 | ○ | ◎ | ○ | ○ |
| 12 | Sn | 10 | ◎ | ◎ | ○ | ◎ |
| 13 | Rh | 0.1 | Δ | ◎ | Δ | Δ |
| 14 | Rh | 0.5 | Δ | ◎ | Δ | Δ |
| 15 | Pd | 0.2 | Δ | ◎ | Δ | Δ |
| 16 | Pd | 3 | Δ | ◎ | Δ | Δ |
| 17 | Pt | 0.05 | Δ | ◎ | ○ | Δ |
| 18 | Pt | 0.1 | ○ | ◎ | ○ | ○ |
| 19 | Pt | 1 | ◎ | ◎ | ○ | ◎ |
| 20 | Pt | 20 | ◎ | ◎ | ○ | ◎ |
| 21 | Cu | 0.5 | Δ | ◎ | Δ | Δ |
| 22 | Cu | 10 | Δ | ◎ | Δ | Δ |
| 23 | Au | 0.1 | Δ | ◎ | Δ | Δ |
| 24 | Au | 2 | Δ | ◎ | Δ | Δ |
| 25 | Ni—B | 10 | ○ | ◎ | ○ | ○ |
| 26 | Ni—P | 10 | ○ | ◎ | ○ | ○ |
| 27 | Sb | 0.1 | ○ | ◎ | ○ | ○ |
| 28 | Sb | 20 | ◎ | ◎ | ○ | ◎ |
| 29 | Ag | 0.05 | Δ | ◎ | ○ | ○ |
| 30 | Ag | 2 | ○ | ◎ | ○ | ○ |
| 31 | no treatment | — | x | ○ | x | x |
| 32 | no treatment | — | Δ | Δ | ○ | Δ |

Obviously, the spark plugs with a built-in resistor fabricated in accordance with the present invention (Sample Nos. 1 to 30) by forming the Ni-based oxide layer 31 or metallic layer 30 on the surface of the center electrode 3 so that it would be directly joined with the resistor 15 had no inferior life characteristics under load to the spark plug of Comparative Example 2 (Sample No. 32) which had neither Ni-based oxide layer 31 nor metallic layer 30 formed on the center electrode 3 but which had the center electrode 3 joined to the resistor 15 via the conductive glass seal layer. In addition, the electrical noise performance of Sample Nos. 1 to 30 was improved (particularly on the higher frequency side) by the increased length of the resistor 15. The spark plug of Comparative Example 1 (Sample No. 31) which had neither Ni-based oxide layer 31 nor metallic layer 30 formed on the surface of the center electrode 3 failed to ensure a satisfactory joint between the center electrode 3 and the resistor 15, with the result that the life characteristic under load and the electrical noise performance on the lower frequency side were by no means satisfactory.

EXAMPLE 2

A fine glass powder (average particle size=80 μm), 70 to 90 wt % of a ceramic $ZrO_2$ powder (average particle size=3 μm), 0.01 to 30 wt % of a metallic Sn, Zn, Sb, Ag or Ni brazing powder (average particle size=20 to 50 μm; each metallic component served as an auxiliary elemental component), 4 to 6 wt % of a nonmetallic conductive carbon black powder, and 1 to 2 wt % of dextrin as an organic binder were wet mixed in water by means of a ball mill. The mixture was thereafter dried to prepare a preform. The Ni brazing was either of the following two types;

(A) Product No. FP-606 manufactured by FUKUDA METAL FOIL & POWDER CO., LTD. consisting of ≦0.15 wt % C, 10 to 12 wt % P and the balance being Ni (solidus temperature: about 885° C.);

(B) Product No. FP-607 manufactured by FUKUDA METAL FOIL & POWDER CO., LTD. consisting of 11.5 to 15.0 wt % Cr, 9.5 to 12 wt % P and the balance being Ni (solidus temperature: about 880° C.).

A preform incorporating 1 wt % of a metallic Al powder was prepared for comparison. The Al powder had such a particle size distribution that at least 99 wt % of the particles passed through a screen having openings of 75 μm and at least 80 wt % of the particles passed through a screen having openings of 45 μm.

To 100 parts by weight of the preform, 400 parts by weight of a coarse glass powder (average particle size=250 μm) was added to prepare a feed powder for a resistor composition. Each glass powder was a lithium borosilicate glass produced from a melt of a formulation consisting of 50 wt % $SiO_2$, 29 wt % $B_2O_5$, 4 wt % $Li_2O$ and 17 wt % BaO; its softening point as 585° C.

Using the powder of resistor composition, various samples of spark plug 100 with a built-in resistor having the construction shown in FIG. 1 were fabricated by the method shown in FIGS. 5 and 6 (Sample Nos. 101 to 125). The center electrode 3 had an outside diameter of 3.5 mm across the electrode fixing rib 3*a* (see FIG. 3) and an axial length of 20 mm. The passing-through-hole 6 in the insulator 2 had an inside diameter of 4.0 mm. For the hot pressing, the heating temperature was set at 900° C. and the applied pressure at 100 kg/cm$^2$. The conductive glass powder was of the same type as used in Example 1.

The spark plug samples fabricated had LR and LS values of 13.5 mm and 15 mm, respectively, with LR/LS being 0.9; LR was the seal length of the resistor 15 and LS was the distance between the opposed ends of the terminal metal fitting 13 and the center electrode 3. The contents of metallic components in the resistor were estimated from the amounts in which they were incorporated in the preform. The estimated contents of the metallic components are shown in Table 2 below together with their species. The electrical noise characteristics of the spark plug samples and their life characteristics under load were measured by the same methods as in Example 1. Thereafter, the contents of the auxiliary elemental components (Sn, Zn, Sb, Ag and Ni) in the resistor 15 were determined by ICP-ES analysis. The overall results are shown in Table 2.

TABLE 2

| Sample | Auxiliary elemental component | | Electrical noise performance | | Life characteristics | Overall |
|---|---|---|---|---|---|---|
| No. | kind | content wt % | 65 MHz | 120 MHz | under load | rating |
| 101 | Sn | 0.02 | ○ | ◎ | ○ | ○ |
| 102 | Sn | 0.4 | ◎ | ◎ | ○ | ◎ |
| 103 | Sn | 2.0 | ○ | ◎ | ○ | ○ |
| 104* | Zn | 0.002 | x | ◎ | x | x |
| 105 | Zn | 0.6 | ◎ | ◎ | ○ | ○ |
| 106 | Zn | 1.0 | ◎ | ◎ | ○ | ◎ |
| 107 | Zn | 2.0 | ○ | ◎ | ○ | ○ |
| 108* | Sb | 0.004 | Δ | ◎ | Δ | Δ |
| 109 | Sb | 0.06 | ○ | ◎ | ○ | ○ |
| 110 | Sb | 1.0 | ◎ | ◎ | ○ | ◎ |
| 111* | Sb | 4.0 | x | ◎ | ○ | x |
| 112* | Ag | 0.002 | x | ◎ | x | x |
| 113 | Ag | 0.1 | ○ | ◎ | ○ | ○ |
| 114 | Ag | 0.4 | ◎ | ◎ | ○ | ◎ |
| 115 | Ag | 2.0 | ○ | ◎ | ○ | ○ |
| 116* | Zn | 3.0 | Δ | ◎ | ○ | x |
| 117* | Zn | 6.0 | x | ◎ | ○ | x |
| 118 | Ag | 4.0 | Δ | ◎ | ○ | Δ |
| 119* | Ag | 4.0 | x | ◎ | ○ | x |
| 120 | Ni(A) | 0.02 | ○ | ◎ | ○ | ○ |
| 121 | Ni(A) | 0.4 | ◎ | ◎ | ○ | ◎ |
| 122 | Ni(A) | 2.0 | ○ | ◎ | ○ | ○ |
| 123* | Ni(B) | 0.01 | x | ◎ | x | x |
| 124 | Ni(B) | 0.1 | ○ | ◎ | ○ | ○ |
| 125 | Ni(B) | 5.0 | ◎ | ◎ | ○ | ◎ |

(A): Ni brazing powder (A) used.
(B): Ni brazing powder (B) used.
*: Samples with the asterisk are outside the scope of the invention.

Obviously, the spark plugs using the resistor 15 containing the auxiliary elemental components in the amounts within the ranges specified by the present invention exhibited satisfactory life characteristics under load although the resistor 15 was directly joined to the center electrode 3. In addition, the spark plugs had an extremely high level of electrical noise performance.

EXAMPLE 3

Various samples of spark plug 100 with a built-in resistor having the construction shown in FIG. 1 were fabricated by the method shown in FIGS. 5 and 6 (Sample Nos. 201 to 203). The center electrode 3 had an outside diameter of 3.5 mm across the electrode-fixing rib 3*a* (see FIG. 3) and an axial length of 20 mm, with a metallic zinc layer 30 being formed in a thickness of 1 μm on the surface of the center electrode 3.

The passing-through-hole 6 in the insulator 2 had an inside diameter of 4.0 mm. For the hot pressing, the heating temperature was set at 900° C. and the applied pressure at 100 kg/cm$^2$. The conductive glass powder was of the same type as used in Example 1. The distance LS between the opposed ends of the terminal metal fitting 13 and the center electrode 3 was fixed at 15 mm; on the other hand, the loadings of the feed powder for the resistor composition and the conductive glass powder were varied so that the seal length (LR) of the resistor 15 was adjusted over the range of 3 to 15 mm and LR/LS from 0.65 to 0.90. The electrical noise characteristics of the fabricated spark plug samples and their life characteristics under load were measured by the same methods as in Example 1. The overall results are shown in Table 3 below.

TABLE 3

| Sample | LR | | Electrical noise performance | | Life characteristics | Overall |
|---|---|---|---|---|---|---|
| No. | mm | LR/LS | 65 MHz | 120 MHz | under load | rating |
| 201 | 15 | 0.65 | Δ | ◎ | ○ | Δ |
| 202 | 15 | 0.70 | ◎ | ◎ | ○ | ◎ |
| 203 | 15 | 0.90 | ◎ | ◎ | ○ | ◎ |

Obviously, the spark plugs of the invention which had a Zn layer formed as the metallic layer 30 on the surface of the center electrode 3 exhibited satisfactory life characteristics under load although the resistor 15 was directly joined to the center electrode 3. It was also evident that at LR/LS values of 0.70 and above, the electrical noise performance on the lower frequency side was particularly satisfactory.

What is claimed is:

1. A spark plug with a built-in resistor, which comprises:

an insulator having an axially extending passing-through-hole;

a terminal metal fitting fixed within the passing-through-hole at an end thereof;

a center electrode fixed within the same passing-through-hole at the other end thereof; and a resistor provided between said terminal metal fitting and said center electrode within said passing-through-hole, said resistor comprising a resistor composition which is a mixture of a glass material portion and an electrically conductive material portion, wherein at least one of said terminal metal fitting and said center electrode is formed with a surface layer with a thickness of 0.1 to 100 μm facing said resistor, said surface layer being a metallic layer comprising at least one selected from the group consisting of Zn, Sn, Pb, Rh, Pd, Pt, Cu, Au, Sb and Ag, and a Ni alloy comprising at least one of B and P, wherein said at least one of said terminal metal fitting and said center electrode is directly in contact with said resistor on the surface of said metallic layer.

2. The spark plug with a built-in resistor according to claim 1, wherein said metallic layer has a thickness of 1 to 20 μm.

3. The spark plug with a built-in resistor according to claim 1, wherein said resistor further comprises at least one auxiliary elemental component selected from the group consisting of Zn, Sb, Sn, Ag, Ni and Al in a total amount of 0.02 to 2 wt %.

4. The spark plug with a built-in resistor according to claim 1, wherein an electrically conductive glass seal layer is interposed between said terminal metal fitting and said resistor, and said center electrode is directly in contact with said resistor.

5. The spark plug with a built-in resistor according to claim 1, wherein LR/LS ≧0.7, with LR=length of the resistor in a longitudinal axial direction of the insulator and LS=distance in said longitudinal axial direction between facing ends of said terminal metal fitting and said center electrode.

6. A spark plug with a built-in resistor, which comprises:

an insulator having an axially extending passing-through-hole;

a terminal metal fitting fixed within the passing-through-hole at an end thereof;

a center electrode fixed within the same passing-through-hole at the other end thereof; and a resistor provided between said terminal metal fitting and said center electrode within said passing-through-hole, said resistor comprising a resistor composition which is a mixture of a glass material portion and an electrically conductive material portion, wherein at least one of said terminal metal fitting and said center electrode is formed with a surface layer facing said resistor, said surface layer being an electrically conductive or semiconductive oxide having a thickness of 0.1 to 100 μm, wherein said at least one of said terminal metal fitting and said center electrode is directly in contact with said resistor on the surface of said oxide layer.

7. The spark plug with a built-in resistor according to claim 6, wherein said resistor further comprises at least one auxiliary elemental component selected from the group consisting of Zn, Sb, Sn, Ag, Ni and Al in a total amount of 0.02 to 2 wt %.

8. The spark plug with a built-in resistor according to claim 6, wherein an electrically conductive glass seal layer is interposed between said terminal metal fitting and said resistor, and said center electrode is directly in contact with said resistor.

9. The spark plug with a built-in resistor according to claim 6, wherein LR/LS ≧0.7, with LR=length of the resistor in a longitudinal axial direction of the insulator and LS=distance in said longitudinal axial direction between facing ends of said terminal metal fitting and said center electrode.

10. A spark plug with a built-in resistor, which comprises:

an insulator having an axially extending passing-through-hole;

a terminal metal fitting fixed within the passing-through-hole at an end thereof;

a center electrode fixed within the same passing-through-hole at the other end thereof; and a resistor provided between said terminal metal fitting and said center electrode within said passing-through-hole, said resistor comprising a resistor composition which is a mixture of a glass material portion and an electrically conductive material portion, wherein at least one of said terminal metal fitting and said center electrode is formed with a surface layer facing said resistor, said surface layer being a Ni-based oxide layer having a thickness of 0.1 to 100 μm, wherein said at least one of said terminal metal fitting and said center electrode is directly in contact with said resistor on the surface of said oxide layer.

11. The spark plug with a built-in resistor according to claim 10, wherein said resistor further comprises at least one auxiliary elemental component selected from the group consisting of Zn, Sb, Sn, Ag, Ni and Al in a total amount of 0.02 to 2 wt %.

12. The spark plug with a built-in resistor according to claim 10, wherein an electrically conductive glass seal layer is interposed between said terminal metal fitting and said resistor, and said center electrode is directly in contact with said resistor.

13. The spark plug with a built-in resistor according to claim 10, wherein LR/LS ≧0.7, with LR=length of the resistor in a longitudinal axial direction of the insulator and LS=distance in said longitudinal axial direction between facing ends of said terminal metal fitting and said center electrode.

14. The spark plug with a built-in resistor according to claim 9, wherein at least part of said auxiliary elemental component is contained in the form of a metallic phase.

15. The spark plug with a built-in resistor according to claim 14, wherein said metallic phase comprises a Ni-base phase containing at least one selected from the group consisting of Cr, B, Si, C, Fe and P.

16. A spark plug with a built-in resistor, which comprises:

an insulator having an axially extending passing-through-hole;

a terminal metal fitting fixed within the passing-through-hole at an end thereof;

a center electrode fixed within the same passing-through-hole at the other end thereof; and a resistor provided between said terminal metal fitting and said center electrode within said passing-through-hole, said resistor comprising a resistor composition which is a mixture of a glass material portion and an electrically conductive material portion, said resistor being directly in contact with at least one of said terminal metal fitting and said center electrode, wherein said resistor composition comprises at least one auxiliary elemental component selected from the group consisting of Zn, Sn, Ag and Ni in a total amount of 0.2 to 1.0 wt %.

17. The spark plug with a built-in resistor according to claim 16, wherein at least part of said auxiliary elemental component is contained in the form of a metallic phase.

18. The spark plug with a built-in resistor according to claim 16, wherein an electrically conductive glass seal layer is interposed between said terminal metal fitting and said resistor, and said center electrode is directly in contact with said resistor.

19. The spark plug with a built-in resistor according to claim 16, wherein LR/LS $\geqq 0.7$, with LR=length of the resistor in a longitudinal axial direction of the insulator and LS=distance in said longitudinal axial direction between facing ends of said terminal metal fitting and said center electrode.

20. A spark plug with a built-in resistor, which comprises:

an insulator having an axially extending passing-through-hole;

a terminal metal fitting fixed within the passing-through-hole at an end thereof;

a center electrode fixed within the same passing-through-hole at the other end thereof; and a resistor provided between said terminal metal fitting and said center electrode within said passing-through-hole, said resistor comprising a resistor composition that has a structure comprising a mixture of a glass material portion with an electrically conductive material portion, said resistor being directly in contact with at least on of said terminal metal fitting and said center electrode, wherein said resistor composition comprises 0.2 to 1.0 wt % Zn as an auxiliary elemental component.

21. The spark plug with a built-in resistor according to claim 20, wherein an electrically conductive glass seal layer is interposed between said terminal metal fitting and said resistor, and said center electrode is directly in contact with said resistor.

22. The spark plug with a built-in resistor according to claim 20, wherein LR/LS $\geqq 0.7$, with LR=length of the resistor in a longitudinal axial direction of the insulator and LS=distance in said longitudinal axial direction between facing ends of said terminal metal fitting and said center electrode.

23. A spark plug with a built-in resistor, which comprises:

an insulator having an axially extending passing-through-hole;

a terminal metal fitting fixed within the passing-through-hole at an end thereof;

a center electrode fixed within the same passing-through-hole at the other end thereof; and a resistor provided between said terminal metal fitting and said center electrode within said passing-through-hole, said resistor comprising a resistor composition which is a mixture of a glass material portion and an electrically conductive material portion, said resistor being directly in contact with at least one of said terminal metal fitting and said center electrode, wherein said resistor composition comprises a Ni-based metallic phase containing at least one selected from the group consisting of Cr, B, Si, C, Fe and P.

24. A spark plug with a built-in resistor, which comprises:

an insulator having an axially extending passing-through-hole;

a terminal metal fitting fixed within the passing-through-hole at an end thereof;

a center electrode fixed within the same passing-through-hole at the other end thereof; and a resistor provided between said terminal metal fitting and said center electrode within said passing-through-hole, said resistor comprising a resistor composition which is a mixture of a glass material portion and an electrically conductive material portion, wherein at least one of said terminal metal fitting and said center electrode is formed with a surface layer facing said resistor, said surface layer being a metallic layer consisting essentially of at least one selected from the group consisting of Zn, Sn, Pb, Rh, Pd, Pt, Cu, Au, Sb and Ag, and a Ni alloy comprising at least one of B and P, wherein said at least one of said terminal metal fitting and said center electrode is directly in contact with said resistor on the surface of said metallic layer.

25. A spark plug with a built-in resistor, which comprises:

an insulator having an axially extending passing-through-hole;

a terminal metal fitting fixed within the passing-through-hole at an end thereof;

a center electrode fixed within the same passing-through-hole at the other end thereof; and a resistor provided between said terminal metal fitting and said center electrode within said passing-through-hole, said resistor comprising a resistor composition which is a mixture of a glass material portion and an electrically conductive material portion, wherein at least one of said terminal metal fitting and said center electrode is formed with a surface layer facing said resistor, said surface layer consisting essentially of an electrically conductive or semiconductive oxide layer having a thickness at least 0.1 $\mu$m, wherein said at least one of said terminal metal fitting and said center electrode is directly in contact with said resistor on the surface of said oxide layer.

26. A spark plug with a built-in resistor, which comprises:

an insulator having an axially extending passing-through-hole;

a terminal metal fitting fixed within the passing-through-hole at an end thereof;

a center electrode fixed within the same passing-through-hole at the other end thereof; and a resistor provided between said terminal metal fitting and said center electrode within said passing-through-hole, said resistor comprising a resistor composition which is a mixture of a glass material portion and an electrically conductive material portion, wherein at least one of said terminal metal fitting and said center electrode is formed with a surface layer facing said resistor, said surface layer consisting essentially of a Ni-based oxide layer having a thickness of at least 0.1 $\mu$m, wherein said at least one of said terminal metal fitting and said center electrode is directly in contact with said resistor on the surface of said oxide layer.

* * * * *